US008277342B2

(12) United States Patent
Bucalo

(10) Patent No.: US 8,277,342 B2
(45) Date of Patent: Oct. 2, 2012

(54) MODIFIED SOCCER GAME

(76) Inventor: Louis R. Bucalo, Miami, FL (US)

( * ) Notice: Subject to any disclaimer, the term of this patent is extended or adjusted under 35 U.S.C. 154(b) by 0 days.

(21) Appl. No.: 12/944,164

(22) Filed: Nov. 11, 2010

(65) Prior Publication Data

US 2011/0059819 A1 Mar. 10, 2011

Related U.S. Application Data

(62) Division of application No. 11/906,679, filed on Oct. 2, 2007, now abandoned.

(60) Provisional application No. 60/850,641, filed on Oct. 10, 2006.

(51) Int. Cl.
*A63B 67/18* (2006.01)
*A63B 69/00* (2006.01)

(52) U.S. Cl. ..... 473/490; 473/446

(58) Field of Classification Search ..... 473/422, 473/438, 446, 470, 471, 476, 477, 478; 434/251
See application file for complete search history.

(56) References Cited

U.S. PATENT DOCUMENTS

| | | | |
|---|---|---|---|
| 3,746,340 | A | 7/1973 | Ellis |
| 4,482,157 | A | 11/1984 | McNeil |
| 6,312,348 | B1 | 11/2001 | Sandell |
| 6,514,160 | B1 | 2/2003 | Cooper |
| 7,156,762 | B1 | 1/2007 | Rondinelli |
| 2002/0137580 | A1 | 9/2002 | Hodge et al. |
| 2004/0018897 | A1 | 1/2004 | Nelson |
| 2006/0189416 | A1 | 8/2006 | Nelson |
| 2007/0021241 | A1 | 1/2007 | Geller et al. |

FOREIGN PATENT DOCUMENTS

WO WO 2007/092895 8/2007

OTHER PUBLICATIONS

Gaetano Indoor Soccer Rules and Regulations—www.gaetanoindoorsoccer.com.*
LiveStrong Indoor Soccer Rules—www.livestrong.com 1) Indoorr Soccer Rules for High school Player—2) The Laws of the indoor soccer game—3) How to compare indoor & outdoor soccer—4) History of Indoor Soccer.*
Manchester College, Intramural Indoor Soccer Rules and Regulations—\\apollo\perc\intramur\Rules\Indoor Soccer Rules_06.doc.*
Campus REC, Indoor Soccer Rules—http://portland-intramurals.ezleagues.ezfacility.com/Rules.aspx?facility_id=327&sport_id=6.*
Wikipedia, Indoor Soccer—http://en.wikipedia.org/wiki/Indoor_soccer.*
The Official Rules of Indoor Soccer, Youth and Amateur Edition (2004)—USISA—www.usindoor.com.*
Virginia Beach Field House—Rules for indoor soccer—http://www.beachfieldhouse.com/.*

(Continued)

*Primary Examiner* — Mitra Aryanpour
(74) *Attorney, Agent, or Firm* — Leason Ellis LLP

(57) ABSTRACT

A modified soccer ("football") field layout and associated modified method of playing soccer on the modified soccer field layout are described. The modified soccer field layout is approximately the same size as a conventional soccer field layout. In one example, the modified soccer field layout also has two Forward Areas and two Forward Lines. In one example, the method of playing soccer on the modified soccer field includes at least one associated Forward Area Soccer Rule.

24 Claims, 4 Drawing Sheets

OTHER PUBLICATIONS

California Family Fitness , Official Indoor Soccer Rules—http://www.californiafamilyfitness.com/documents/sports_parties_and_rentals/soccer/Official%20Indoor%20Soccer%20Rules.pdf.*

Sports City Indoor Soccer Center Laws of the Game—http://www.nbsportscity.com/Rules/rules.htm.*

SoccerDome III, Indoor Soccer Rules and Regulations—http://soccerdome-3.ezleagues.ezfacility.com/Rules.aspx?facility_id=808&sport_id=6.*

The University of Alabama, Rules of the Game for Intramural Indoor Soccer—http://www.google.com/search?q=The+University+of+Alabama%2C+Rules+of+the+Game+for+Intramural+Indoor+Soccer&rls=com.microsoft:en-us:IE-SearchBox&ie=UTF-8&oe=UTF-8&sourceid=ie7&rlz=1I7GGLD.* http://www.kyreferee.com/PDF/2006IndoorRules.pdf 2006 United States Soccer Federation—Indoor Playing Rules Rule 13.4(m)(1) and(2), 14.2 and 14.4.*

Anonymous. (Dec. 2003). "Official Guide 2003. Playing Rules: Hurling and Football," located at <http://www.gaa.ie/files/official_playing_rules.pdf>, last visited on Feb. 8, 2007, 94 pages.

Anonymous. (2004). The Official Rules of Indoor Soccer: Youth and Amateur Edition, United States Indoor Soccer Association, 9 pages.

Anonymous. (2005). "NHL.com—Rulebook," located at <http://www.nhl.com/hockeyu/rulebook/>, last visited on Oct. 1, 2007, 209 pages.

Anonymous. (Jul. 2006). Laws of the Game 2006, Federation Internationale de Football Association: Zurich, Switzerland, 42 pages.

Anonymous. (2007). "NBA.com: Official Rules of the National Basketball Association," located at <http://www.nba.com/analysis/rules index.html>, last visited on Oct. 1, 2007, 73 pages.

Anonymous. (2007). "NFL Digest of Rules," located at <http://www.nfl.com/rulebook/digestofrules>, last visited on Oct. 1, 2007,45 pages.

Anonymous. (2007). "The Official Site of Major League Baseball: Official info: Official Rules," located at <http://mlb.mlb.com/mlb/official info/official rules/foreword.jsp>, last visited on Oct. 1, 2007, 54 pages.

Anonymous. (Date Unknown). "Soccer Field Diagram," located at <http://www.sportsknowhow.com/images/diagrams/soccer-field-dimensions-diagram-lrg.gif>, last visited on Sep. 17, 2007, 1 page.

* cited by examiner

MODIFIED SOCCER GAME

CROSS-REFERENCE TO RELATED APPLICATION

This application is a divisional application of U.S. patent application Ser. No. 11/906,679, filed Oct. 2, 2007, which claims the benefit of U.S. Provisional Application No. 60/850,641, filed Oct. 10, 2006, which is hereby incorporated by reference herein in its entirety for all purposes.

BACKGROUND OF THE INVENTION

The present invention relates generally to a modified field layout for playing soccer (in U.S. parlance, otherwise "football") and methods of playing soccer on the modified field layout. The present modified soccer field is approximately the same size as a conventional soccer field in length and width and the modified soccer game uses many of the same rules as conventional soccer.

Soccer is the world's most popular sport, with over twenty-eight billion total viewers to the FIFA World Cup event and over one billion viewers to the televised World Cup Final. Spectator interest in soccer outside the United States is also very high for regularly scheduled, weekly televised professional soccer matches. However, adult spectator interest in televised professional soccer, aside from the World Cup itself, remains very low on a national basis in the United States. This is not due to lack of exposure to conventional soccer, since childhood participation in soccer in the United States is among the most common organized sport activities. Victory by the United States women's team in the Olympics in 1996 and 2004, and the United States women's team FIFA World Cup victories in 1991 and 1999, also substantially established awareness and exposure to conventional soccer broadly throughout the United States. Despite these facts, conventional soccer continues to have a very low television audience and low attendance at professional soccer matches in the United States.

Baseball, American football, and basketball command United States television viewer national attention week after week. Soccer also has this potential, as evidenced by it being the most popular spectator sport in the world and the most popular childhood participation sport in the United States.

BRIEF SUMMARY OF THE INVENTION

The present modified soccer game helps make soccer a broad-based, national spectator sport exciting to American (and other) sports fans. The present modified soccer game will help establish a larger spectator base for professional soccer in the United States and create a new market for sports media products and services, as well as soccer-related products and services in the sporting goods industry. The present modified soccer game will help accomplish these objectives while maintaining in some embodiments the same size field and goals as conventional soccer, with modifications to some of the rules of the game and some of the features of the field.

The present inventor has identified that there are many reasons for conventional soccer's relatively low spectator popularity in the United States, despite the very broad childhood exposure and familiarity with conventional soccer, extensive nationwide little league participation, and high profile United States women's team professional victories. The following are believed to be some reasons for conventional soccer's relatively low spectator popularity in the United States: soccer is viewed by some U.S. sports fans as being a foreign game; some U.S. sports fans believe that the game is too low scoring and that there are too many draws (particularly low scoring draws); and many U.S. sports fans simply think that conventional soccer is boring. Soccer players often end up clustered around a soccer ball in large numbers and the soccer ball rarely remains with any given player for very long before one of a cluster of opponent players kicks it away or forces the player to give the ball away. Conventional soccer provides little opportunity for regularly establishing and executing set scoring plays that are easily recognized and demonstrate strategy and visually impressive athletic skills.

Professional soccer players have great athletic abilities and exceptional skills in ball handling. These skills are very impressive and entertaining when demonstrated in practice drills and ball handling exhibitions. However, players rarely get the chance to demonstrate these skills during conventional soccer games to the extent required to drive interest for an American audience. The present inventor believes that the absence of this important visual entertainment and the lack of recognizable set scoring plays result in too few easily appreciated visual demonstrations of athletic prowess to hold interest for the general American audience. This, along with the low number of shots on goal, low scoring, and frequent 0-0 or 1-1 draws, make conventional soccer relatively boring and much less appealing to most .U.S. audiences, compared to baseball, American football, and basketball.

Viewer excitement would increase if individual players regularly had the opportunity to advance the soccer ball a significant distance against opposition, demonstrating exceptional ball handling skills and control, and if players could often set up different types of recognizable specific plays that lead to shots on goal. Viewer interest would increase if professional soccer games routinely ended with multiple goals scored by each team and numerous shots on goal throughout the game. Soccer would be much more exciting and entertaining to a typical U.S. spectator if an increased number of goals also routinely derived from impressive scoring events that clearly demonstrate exceptional athletic ability such as kicking powerfully and accurately over a longer distance into the goal, out running and maneuvering an opponent one-on-one with impressive ball handling, and set plays whose patterns fans can recognize and appreciate. In the present modified soccer game, these exciting events will occur more often in each game, transforming soccer into a major spectator sport for the U.S. audience. The present modified soccer game rewards aggressive play and encourages teams to pursue dynamic, attacking strategies. The intended result is more shots on goal, more goals scored, numerous set scoring plays that fans can recognize and appreciate, and more opportunities for demonstrations of exceptional ball handling skills, speed, and athletic prowess.

In summary, the following two elements are intended to establish and maintain a large, national, weekly spectator base for a sport in the United States and elsewhere:

1. Powerful, visually impressive scoring events that occur several times per game.

2. Specific, recognizable plays occurring often per game whose performance demonstrates strategy and athletic skill.

These elements provide the visual entertainment content to help establish and maintain a large, national, weekly sports spectator audience in the United States. American football, basketball, and baseball provide these spectator elements to U.S. television viewers. Conventional soccer does not. The present modified soccer game does this while maintaining the same overall objectives, equipment, and athletic skills as conventional soccer.

It is useful to examine some of the key elements of soccer's appeal outside the United States to fully understand how to create broad soccer appeal, e.g., in the United States. Many international soccer fans have a strong cultural affiliation with conventional soccer, particularly throughout Europe and South America. Conventional soccer is often considered a "beautiful" game and there is a strong national cultural attachment and pride associated with participation in the sport. There is also a very strong national pride for and affiliation with each country's respective soccer team. There is a strong national identity attached to each country's team, and in fact, many international teams are seen as playing conventional soccer in a manner and style that reflects the respective countries' cultures, and they are often seen as a version of the respective countries' personalities. In short, conventional soccer's vast international popularity is largely driven by a strong national and cultural affiliation with each country's own soccer team. Thus, a national affiliation with soccer at the professional level in the United States would help develop a broad, national spectator base for soccer in the United States. This third element, in addition to the two elements previously discussed, is intended help to develop a broad-based, national, weekly audience for a professional sport in the United States. Baseball, basketball, and American football are all viewed by Americans as American sports. This is currently not the case for conventional soccer in the United States, despite the women's Olympic team and women's World Cup victories. The present modified soccer game establishes a uniquely American brand that can also translate easily to other soccer-playing nations.

As previously discussed, many international soccer fans consider conventional soccer a "beautiful" game. When modified forms of soccer have been attempted in the past, such as indoor soccer on a small field, these have not been widely accepted by conventional soccer fans. This lack of acceptance is likely because the differences from conventional soccer have been too great. For example, indoor soccer is a very different game from both conventional soccer and the present modified soccer game because indoor soccer is essentially played in a hockey rink, with a much smaller field and smaller goals. This changes the specific athletic skills and foot-eye-body training and coordination developed by professional soccer players. Because of these, and other, differences, indoor soccer is not very popular among conventional soccer fans, many of whom think that indoor soccer is not a real soccer game. In contrast, the present modified soccer game in certain embodiments maintains the same size field, the same size goals, and many of the same rules as conventional soccer in order to maintain the beauty of the game and relevance of the specific athletic skills used in conventional soccer, while making a few modifications to the rules and the internal layout of the field to make the game more exciting to American spectators. Thus, the present modified soccer game allows soccer players to use the same athletic skills that they have practiced and finely honed for conventional soccer because of the use of the same size soccer ball, field, and goals. The present modified soccer game could also be played during the off-season of conventional soccer by professional soccer players to complement conventional soccer, rather than replace conventional soccer, and to provide additional revenue opportunities for players and teams.

With its designated changes, the present modified soccer game captures the talent, experience, facilities, equipment, and untapped potential of conventional soccer and directs these powerful, yet currently underutilized, resources into an exciting national spectator sport with, e.g., an American identity. The modified soccer field disclosed here in some embodiments is approximately the same size as a conventional soccer field and the present modified soccer game uses many of the same rules as conventional soccer.

The present modified soccer field in some embodiments includes areas called Forward Areas, which are not present on conventional soccer fields. The present modified soccer game in certain embodiments is played according to least one Forward Area Soccer Rule, which means that the application of that at least one rule depends on whether one or more identified actions occur inside of one or more Forward Areas defined on the modified soccer field. For example, one Forward Area Soccer Rule sets a maximum number of players from each team who are allowed in each Forward Area at a time. Another exemplary Forward Area Soccer Rule sets a period of time, also known as a goal clock, for a team to take a shot on goal once the team has possession of a soccer ball in an opposing team's Forward Area. Yet another exemplary Forward Area Soccer Rule limits the application of offsides penalties from conventional soccer to only apply if certain actions take place inside of a Forward Area. In various embodiments, one or more of these rules are employed.

In conventional soccer, goal boxes, also known as goal areas, are defined on a conventional soccer field in front of each team's respective goal. The size of goal boxes on some embodiments of a modified soccer field is expanded relative to the size of goal boxes on a conventional soccer field. Certain embodiments of the present modified soccer game include one or more rules which apply to actions that take place inside the goal boxes. For example, one exemplary rule provides that no player, other than a defending goal keeper, may be in a defending team's goal box for more than a set period of time without possession of a soccer ball. Another exemplary rule provides that a shot on goal which is made by an attacking team from within a defending team's goal box, and which goes in the defending team's goal, is only counted as a scored goal if the shot on goal is made by either a header shot or a scissor kick shot.

In order to deter many fouls, teams may be penalized for certain fouls by awarding an opposing team a free kick from Direct Kick Spots located in front of goals on a modified soccer field. Additionally, teams may be penalized for certain fouls by requiring an offending team to play without one or more players for a set amount of time.

The modified soccer game may be played in three separate periods, with a break between periods. The present modified soccer game may be played with fewer players per team than conventional soccer. Player substitutions are permitted in certain versions of the present modified soccer game, wherein active players are allowed to leave and reenter the modified soccer game. Teams are allowed to call timeouts in some versions of the present modified soccer game.

The present modified soccer game encourages powerful, visually impressive scoring events to occur several times per game. Additionally, the modified soccer game allows for more specific, recognizable scoring plays to occur often per game which viewers can recognize and which demonstrate strategy and great athletic skill. Further, the modified soccer game will help develop a national affiliation with soccer at the professional level. These features of the present modified soccer game will help establish a broad, national spectator base for soccer in the United States.

Various examples and aspects of the present invention are better understood upon consideration of the detailed description below in conjunction with the accompanying drawings and claims.

DETAILED DESCRIPTION

Figure 1:
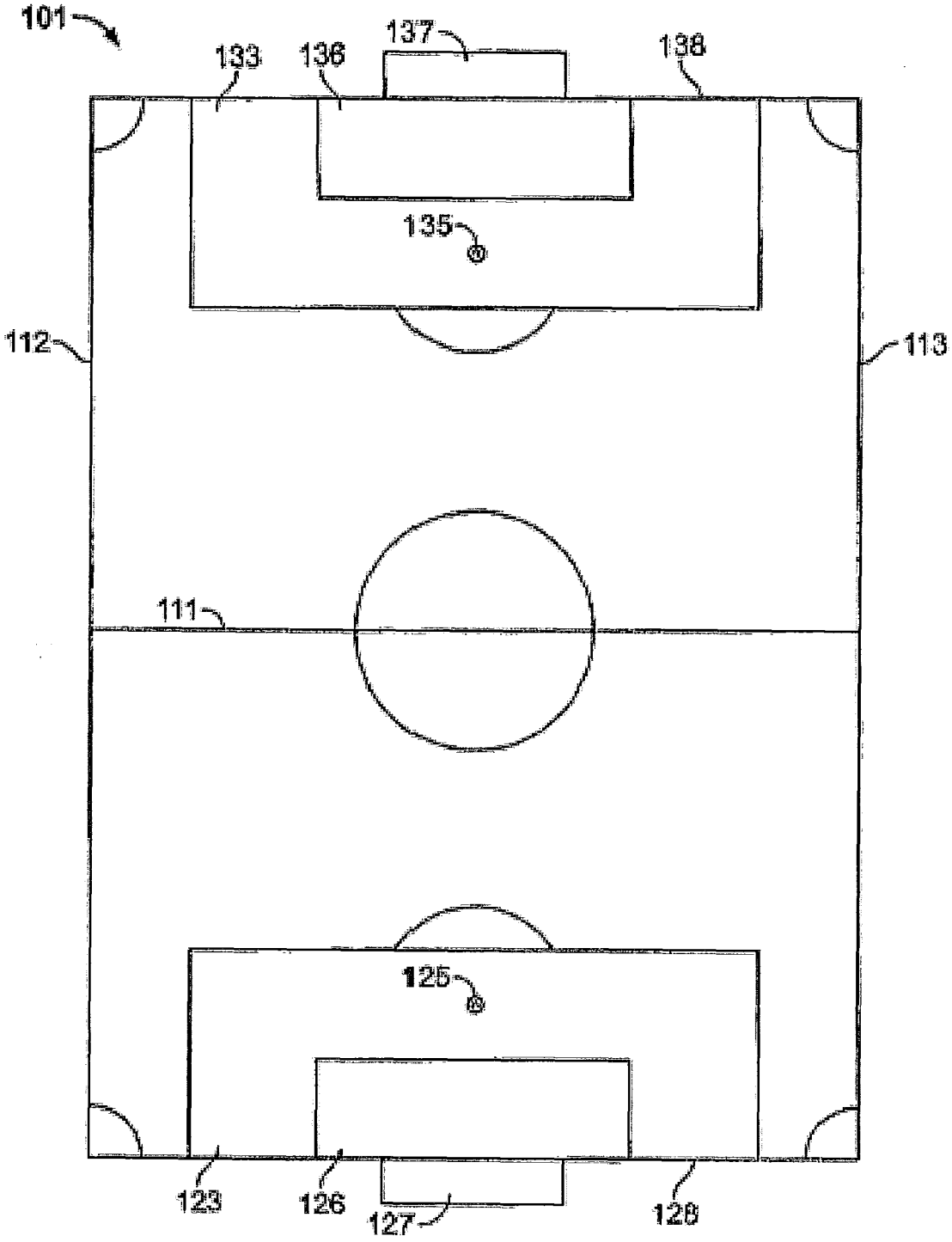
(Prior Art) FIG. 1
FIG. 1 is a plan view of a conventional soccer field.

The following description sets forth numerous specific rules, parameters, and the like. It should be recognized, however, that such description is not intended as a limitation on the scope of the present invention, but is instead provided as a description of exemplary embodiments. Various modifications to the examples described will be readily apparent to those of ordinary skill in the art, and the general principles defined may be applied to other examples and applications without departing from the spirit and scope of the invention. Thus, the present invention is not intended to be limited to the examples described herein and shown, but is to be accorded a scope consistent with the claims.

The present modified soccer game uses many of the same rules and equipment as conventional soccer, incorporates new elements to the soccer field, modifies the placement of players, and adds or modifies certain rules. Some examples of "conventional soccer" include Federation Internationale de Football Association ("FIFA"), Major League Soccer ("MLS"), and the United Soccer League. Unless specifically changed, the rules and field of the present modified soccer game remain the same as those in conventional soccer. Unless otherwise noted, the rules of FIFA will be considered as the rules of "conventional soccer" in one exemplary embodiment. The rules of FIFA, "Laws of the Game 2006" published by Federation Internationale de Football Association in July 2006, are hereby incorporated by reference in their entirety herein for all purposes.

The present modified soccer game is intended to be more exciting and entertaining to watch for average U.S. viewers than conventional soccer because the present modified soccer game increases the average number of shots on goal and the average number of goals scored per game, without necessarily changing the size of the field or the size of the goals. Additionally, the goals scored in the present modified soccer game are often more impressive and exciting to watch because they are more often scored from further away from the goal and from header shots and scissor kick shots. Further, the present modified soccer game encourages more long passes, which are more exciting to watch than the numerous short passes that occur in conventional soccer to advance the ball down the field. The elements of the present modified soccer game generally allow players more opportunity to dribble a soccer ball down field further on their own than in conventional soccer, which is more exciting than simply watching players in conventional soccer games spend most of the time fighting for possession of the ball. In the present modified soccer game, the number of set plays leading to shots on goal during active play is greatly increased. U.S. sports fans generally like seeing set plays that they can recognize. This helps viewers focus their attention and appreciate the teams' strategies. Conventional soccer does not lead to many set plays during active play. The main set plays in conventional soccer are corner kicks and penalty kicks, which are performed after play is stopped and are not inherently very interesting to watch and which often have a predictable outcome. Many sports fans like to see set plays that they recognize, which occur during active play and lead to scoring.

The following terms are often used interchangeably in normal usage in describing soccer: a "sideline" is also referred to as a "touch line"; a "midline" is also referred to as either a "mid field line" or a "halfway line"; an "endline" is also referred to as a "goal line"; a "penalty box" is also referred to as a "penalty area"; a "goal box" is also referred to as a "goal area"; and "soccer" is also called "football" in most countries. An "attacking team" is a team that has possession of the soccer ball at a point in time during a soccer game. The attacking team may also be referred to as an "offensive team" or a "team on offense." A "defending team" is a soccer team that does not have possession of the soccer ball at the point in time when the attacking team has possession. The defending team may also be referred to as a "defensive team" or a "team on defense." The terms "first" and "second" are used in this application to identify different teams, players, or other elements of the modified soccer game. These terms may be used interchangeably between different elements and are not meant to imply any particular ordering. For example, if there are two teams, Team A and Team B, then the application of a rule may refer to a "first team" and a "second team" for ease of reference in order to explain the application of a rule. On one play, for example, Team A may be the "first team" as applied to a particular rule. However, on another play, Team B may be the "first team" with reference to the same or a different rule. Thus, the terms "first team" and "second team" are simply intended to help illustrate a rule as applied to two separate teams, but they are not meant to restrict application of a rule or field element to only one team or field element for an entire game.

Figure 2:
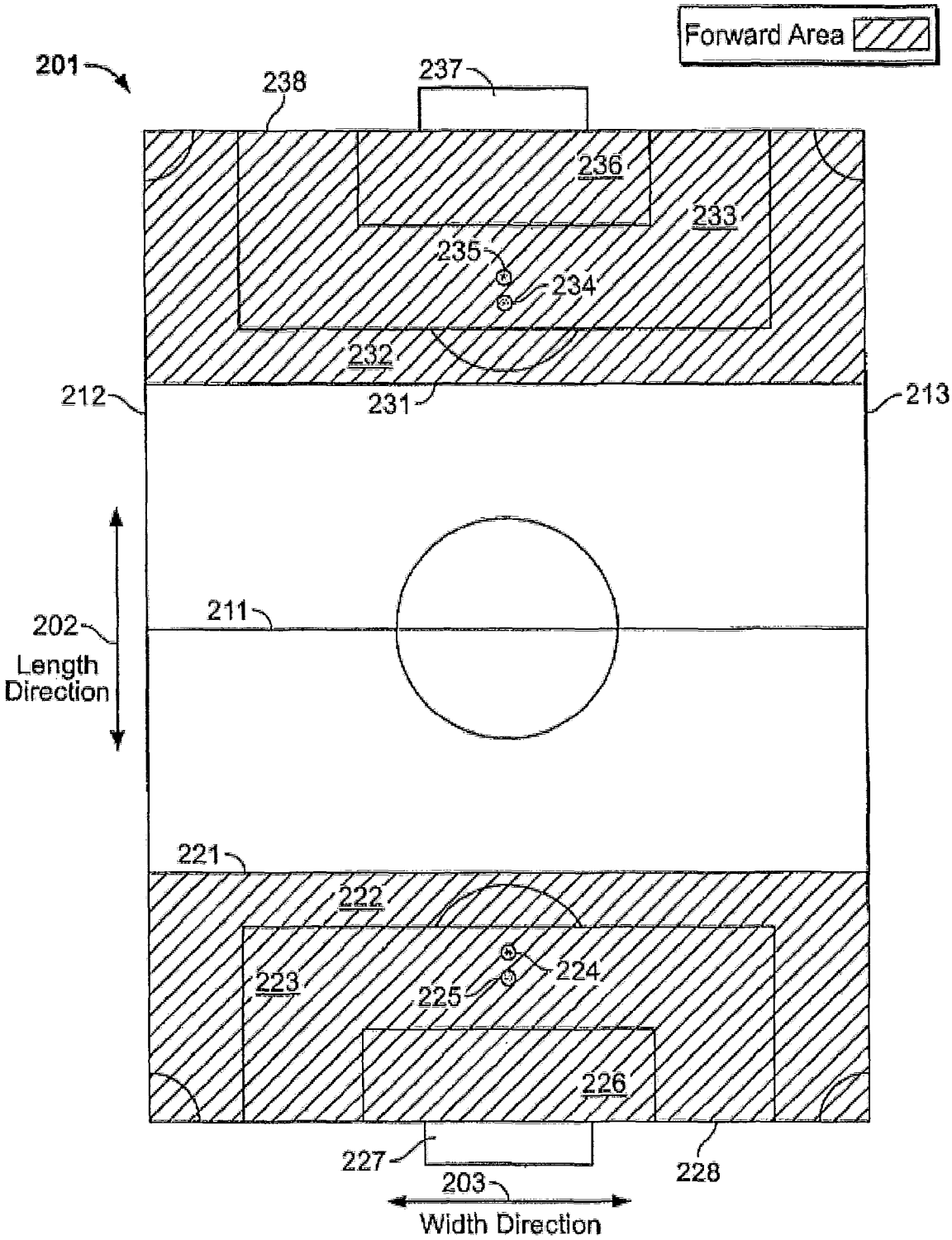
FIG. 2 is a plan view of an exemplary modified soccer field with Forward Lines and Forward Areas.

The present invention may be more readily understood in reference to the drawings. FIG. 1 is a plan view of an exemplary Conventional soccer field 101. The exemplary conventional soccer field has two goals 127, 137, two endlines 128, 138, two sidelines 112, 113, one midline 111, two goal boxes 126, 136, two penalty boxes 123, 133, and two penalty marks 125, 135. FIG. 2 is a plan view of an exemplary modified soccer field 201 with two Forward Lines 221, 231 and two Forward Areas 222, 232. A longer direction of the field 201 (goal to goal) may be referred to as a "length direction" 202 of the field and a shorter direction of the field 201 (perpendicular to the longer direction) may be referred to as a "width direction" 203 of the field 201.

Two Forward Lines 221, 231 each extend across a width direction 203 of the modified soccer field 201. A first Forward Line 221 is located on a first side of a midline 211. A second Forward Line 231 is located on a second side of the midline 211. The first Forward Line 221 is located between the midline 211 and a first endline 228. The second Forward Line 231 is located between the midline 211 and a second endline 238. In some embodiments of the present modified soccer field, the first Forward Line 221 is located approximately twenty to twenty-six yards (18.3 to 23.8 meters) in front of the first endline 228 and the second Forward Line 231 is located approximately twenty to twenty-six yards (18.3 to 23.8 meters) in front of the second endline 238. "Approximately," for example, means plus or minus ten percent of a stated value or range.

A first Forward Area 222 is located on the first side of the midline 211. A second Forward Area 232 is located on the second side of the midline 211. The Forward Areas 222, 232 are defined by length direction sides and width direction sides. The length direction sides of the Forward Areas 222, 232 are defined by two opposing sidelines 212, 213. The width direction sides of the first Forward Area 222 are defined by the first endline 228 and the first Forward Line 221. The width direction sides of the second Forward Area 232 are defined by the second endline 238 and the second Forward Line 231.

In some embodiments of the present modified soccer game, one or more rules depend on whether one or more actions identified in a set of modified soccer rules occur inside of one or more Forward Areas 222, 232 on a modified soccer field 201. A "Forward Area Soccer Rule" is a rule in the present modified soccer game for which the application of the rule depends on whether one or more identified actions occur inside of one or more Forward Areas 222, 232 on a modified soccer field 201.

Figure 3:
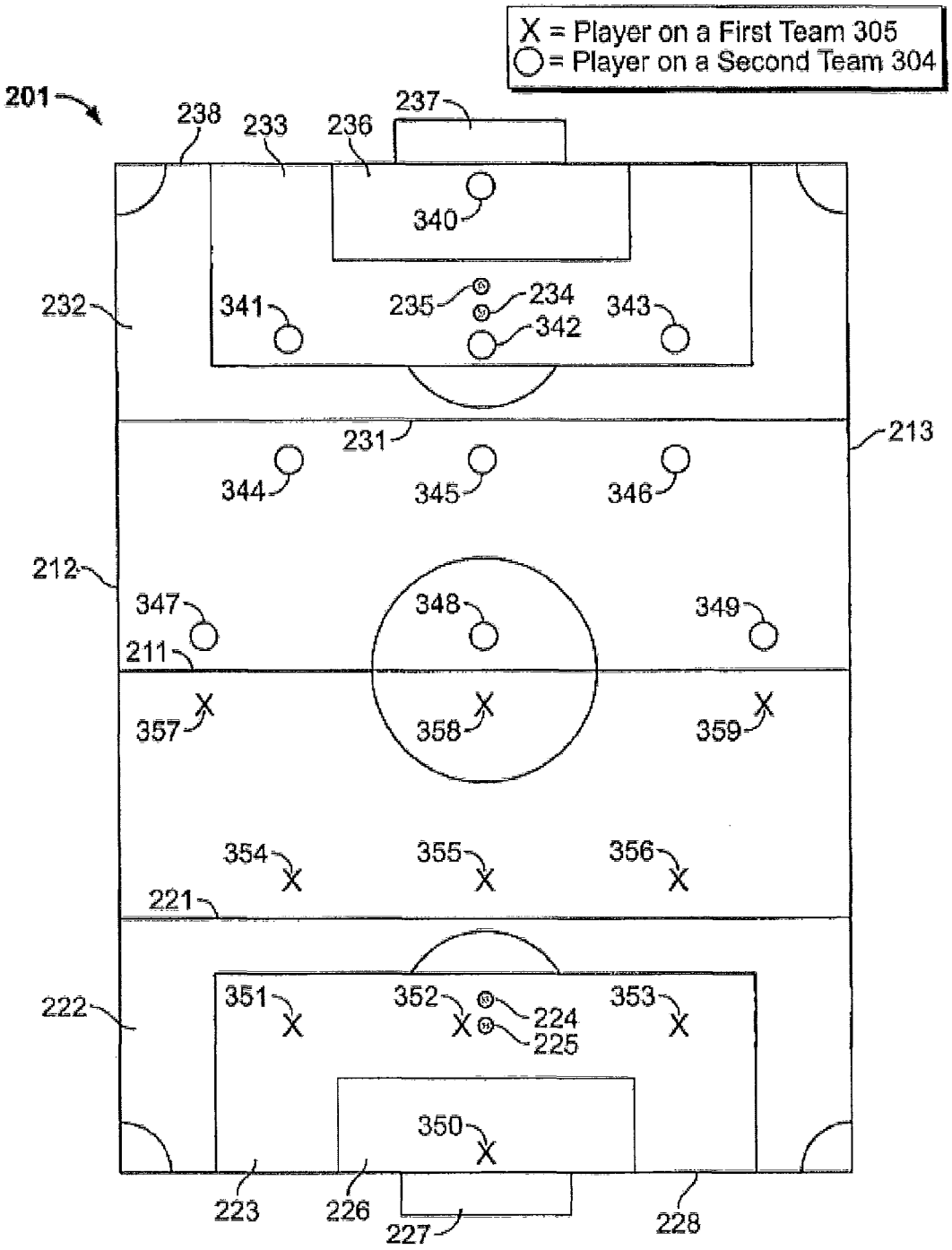
FIG. 3 is a plan view of an exemplary modified soccer player initial set-up on an exemplary modified soccer field.

FIG. 3 is a plan view of an exemplary modified soccer player initial set-up on an exemplary modified soccer field. In FIG. 3, players 350-359 on a first team 305 are illustrated by "X" symbols and players 340-349 on a second team 304 are illustrated by "O" symbols. The Forward Areas 222, 232 may be referred to by reference to the respective teams 304, 305. For example, if there are two teams, a first team 305 and a second team 304 respectively, then a Forward Area 222 adjacent to a goal 227 that the first team 305 is defending may be referred to as the first team's Forward Area 227 and a Forward Area 232 adjacent to a goal 237 that the second team 304 is defending may be referred to as the second team's Forward Area 232. Similarly, other elements of the field may be referred to by reference to the respective teams. For example, the goal 227 that the first team 305 is defending may be referred to as the first team's goal 227, a goal box 226 located in the first team's Forward Area 222 may be referred to as the first team's goal box 226, a penalty box 223 located in the first team's Forward Area 222 may be referred to as the first team's penalty box 223, and an endline 228 located adjacent to the first team's goal 227 may be referred to as the first team's endline 228.

One exemplary Forward Area Soccer Rule provides that once a player of a first team 305 is in possession of the soccer ball in a second team's Forward Area 232, the first team 305 has a set period of time in which to take a shot on goal. This period of time may be referred to as a "goal clock." In some embodiments of the present modified soccer game, the set period of time to take a shot on goal is approximately ten to twenty-five seconds. In certain embodiments, if the first team 305 does not take a shot on goal before expiration of the goal clock, then the soccer ball changes possession and possession is given to a goal keeper 340 on the second team 304. In some embodiments of the present modified soccer game, each shot on goal resets the goal clock. In some embodiments of the present modified soccer game, the goal clock is reset if the second team 304 has possession of the soccer ball outside of the second team's Forward Area 232, and it begins again with possession of the soccer ball by the first team 305 in the second team's Forward Area 232. In some embodiments of the present modified soccer game, the goal clock for the first team 305 to take a shot on goal is reset if the soccer ball goes out of bounds off of a defending player on a second team 304 in the second team's Forward Area 232. In some embodiments of the present modified soccer game, a team is penalized if a player on the team leaves the second team's Forward Area 232 while the goal clock is running and then reenters the second team's Forward Area 232 before the goal clock has either expired or been reset. If the goal clock is "reset", then the amount of time on the goal clock is set to the predefined set time period allowed to take a shot on goal. For example, if the predefined set period of time for a first team 305 to take a shot on goal is fifteen-seconds and the first team 305 maintains possession of the soccer ball in the second team's Forward Area 232 for seven seconds, then eight seconds will remain on the goal clock for the first team 305 to take a shot on goal. If the second team 304 then steals the soccer ball and obtains possession of the soccer ball outside of the second team's Forward Area 232, then the goal clock is reset to fifteen seconds and the goal clock will start again, with the full set time allotment of fifteen seconds, if either team subsequently obtains possession of the soccer ball in an opposing team's Forward Area.

Figure 4:
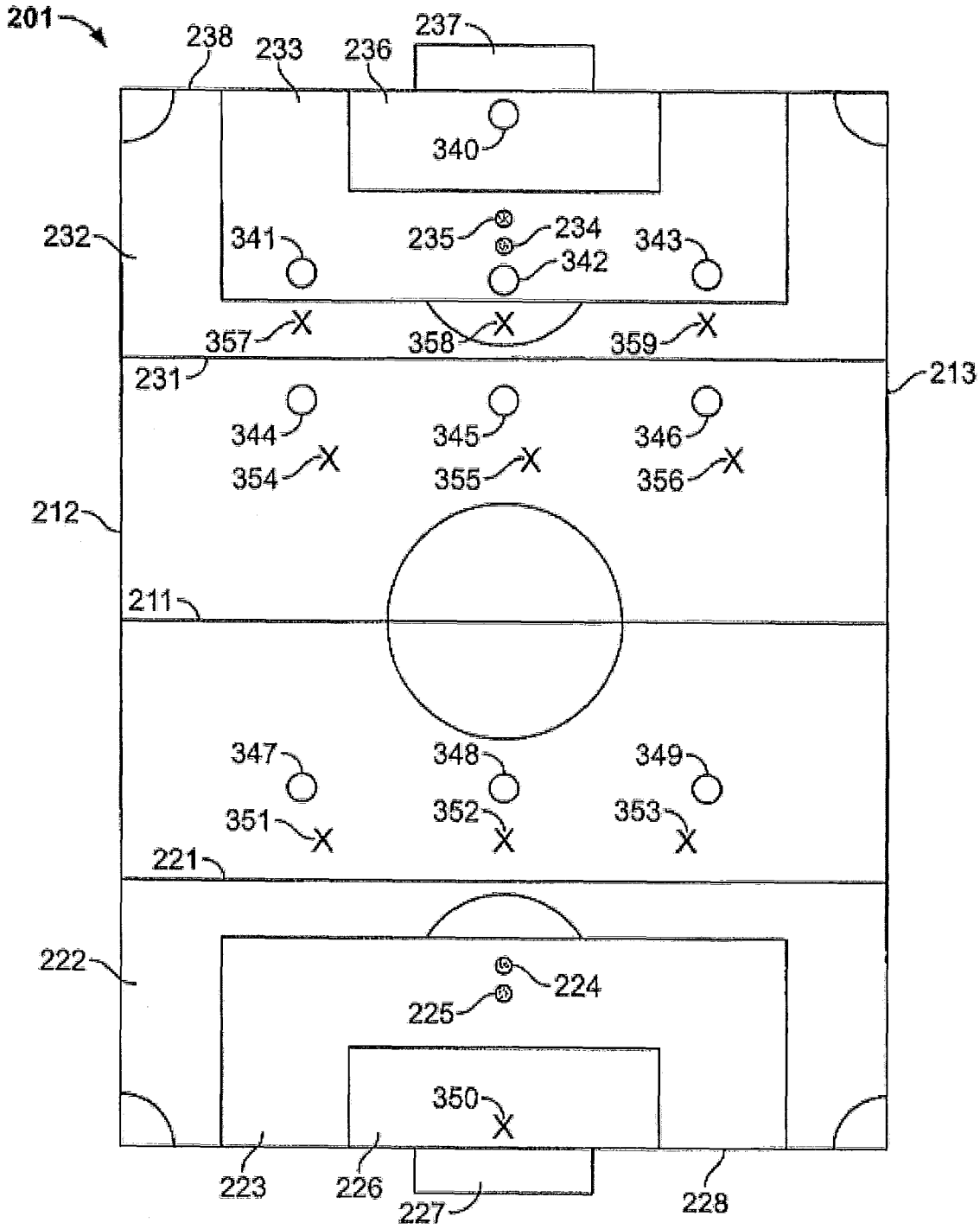
FIG. 4 is a plan view of an exemplary modified soccer player location and deployment on an exemplary modified soccer field.

One exemplary Forward Area Soccer Rule penalizes a team if more than a limited, set number of players from the team are in a Forward Area 222, 232 at a time. Different players may enter and leave the Forward Areas 222, 232, as long as no more than a set number of players from each team 304, 305, not including a defending goal keeper, are in each Forward Area 222, 232 at a time. In some embodiments of the present modified soccer game, the set number of players from each team who may be in each Forward Area 222, 232 at a time is between two and five players. In FIG. 4, for example, a maximum of three players 357-359 on a first team 305 are in a Forward Area 232 of a second team 304 and three players 341-343 on the second team 304, not counting a goal keeper 340 on the second team 304, are in the second team's Forward Area 232 at a time.

One exemplary Forward Area Soccer Rule provides that a player on a first team 305 who makes a corner kick or throw-in in a second team's Forward Area 232 must reenter the field outside of the second team's Forward Area 232 after making the throw-in or corner kick. If there is a set maximum number of players who are allowed in each Forward Area 222, 232 per team at a time, then the player making the throw-in or corner kick is not counted towards that maximum number of players.

One exemplary Forward Area Soccer Rule provides that when a corner kick is made by a player on a first team 305 in a second team's Forward Area 232, only one other player from the first team 305 is allowed in the second team's Forward Area 232 at the time of the corner kick, and a goal keeper 340 on the second team 304 is the only player from the second team 304 who is allowed in the second team's Forward Area 232 at the time of the corner kick.

One exemplary Forward Area Soccer Rule penalizes a first team 305 if a player, other than a goal keeper 350, on the first team 305 kicks the soccer ball from a first team's Forward Area 222 to a second team's Forward Area 232 without the soccer ball being touched by another player before landing in the second team's Forward Area 232. In some embodiments of the present modified soccer game, the penalty on the first team 305 results in the second team 304 being given a throw-in at the sideline in front of the first team's Forward Area 222.

One exemplary Forward Area Soccer Rule penalizes a team if the team exceeds a set number of defensive out of bounds off the team to the sidelines 212, 213 in the team's Forward Area 222, 232 per period. A defensive out of bounds occurs when the last player to contact the soccer ball before the soccer ball goes out of bounds is a member of a defending team in the defending team's Forward Area 222, 232. Once a first team 305 has reached the set number of defensive out of bounds, the next out of bounds off the first team 305 in the first team's Forward Area 222 results in a direct kick for the second team 304. In some embodiments of the present modified soccer game, the set number of defensive out of bounds is approximately ten. In some embodiments of the present modified soccer game, the direct kick is taken by the second team 304 from a Direct Kick Spot 224 in front of the first team's goal 227. In some versions of the present modified soccer game, the direct kick may be taken by the second team 304 from the center of the first team's Forward Line 221.

Conventional soccer has a penalty called "offsides". In certain embodiments of the present modified soccer game, one Forward Area Soccer Rule limits the application of offsides penalties from conventional soccer to only apply if certain actions take place inside of a Forward Area. One exemplary Forward Area Soccer Rule provides that the penalty for offsides from conventional soccer is only applied in the present modified soccer game if an attacking player on a first team 305, who is outside of a second team's Forward Area 232, passes the soccer ball to an attacking teammate, who is inside the second team's Forward Area 232, who would have been offsides based on conventional soccer rules. For example, in certain embodiments of the present modified soccer game, an offsides penalty is only assessed if a soccer ball is passed from a passing attacking player on a first team 305 who is outside of a second team's Forward Area 232 to a receiving attacking player on the first team 305 who either receives the pass or is in position to receive the pass and who is inside the second team's Forward Area 232 and there are not at least two defending players on the second team 304, including a defending goal keeper 340 on the second team 304 if applicable, between the receiving attacking player on the first team 304 and the second team's endline 238 at the time of receipt of the pass. Accordingly, in certain embodiments of the present modified soccer game, there are no offsides penalties for passes made to receiving attacking players who are not inside a defending team's Forward Area at the time of the pass. Additionally, in certain embodiments of the present modified soccer game, there are no offsides penalties for passes made by an attacking team while the attacking team has possession of the ball in a defending team's Forward Area. By limiting the applicability of offsides penalties as compared to conventional soccer, the present modified soccer game allows attacking teams to quickly advance the soccer ball downfield up to a defending team's Forward Area, while still providing some protection for a defending goal keeper by not permitting a pass into the Forward Area without at least one additional defending player between an attacking player in the defending team's Forward Area and the defending goal keeper.

Certain embodiments of the present modified soccer game use fewer players on the modified soccer field 201 for each team 304, 305 than conventional soccer. This allows more opportunity for demonstration of individual skill, allows longer passes which are more interesting to watch, avoids crowding around the ball, and moves play along more quickly. Certain embodiments of the present modified soccer game utilize seven to ten players on the modified soccer field 201 for each team 304, 305 at a time.

Some embodiments of the present modified soccer game require each team 304, 305 to keep a minimum number of players, not including a defending goal keeper, on each side of a midline 211 on the modified soccer field 201 at a time after a first change of possession during each period. In some embodiments of the present modified soccer game, the minimum number of players required to be on each side of the midline 211 at a time is three players per team 304, 305. In FIG. 4, for example, a minimum of three players 351-353 on a first team 305, not counting a defending goal keeper 350 on the first team 305, and three players 347-349 on a second team 304 are located on a first side of the midline 211 at a time. This opens up the field, prevents crowding around the ball, creates longer passes, and provides players greater opportunities to demonstrate individual athletic skill.

The present modified soccer field 201 conventionally may be comprised of many different types of surfaces. For example, the modified soccer field 201 may be comprised of grass, polymers, artificial grass, or any other surface amenable to soccer play. The lines delineating the portions of the field may be indicated by paint, tape, lime, chalk, of other conventional means.

In the present modified soccer game, two goal boxes 226, 236 are defined on a modified soccer field 201. A first goal box 226 is located on a first side of a midline 221 and a second goal box 236 is located on the second side of the midline 221. The goal boxes 226, 236 on the modified soccer field 201 are located in front of each goal 227, 237. The goal boxes 226, 236 are defined by length direction sides and width direction sides. One width direction side of the first goal box 226 is located along a first endline 228. One width direction side of the second goal box 236 is located along a second endline 238. The size of the goal boxes 226, 236 in some embodiments of the modified soccer field 201 is expanded relative to the size of goal boxes 126, 136 in conventional soccer. The length direction sides of the goal boxes 226, 236 are approximately seven to nine yards (6.4 to 8.2 meters) long and the width direction sides of the goal boxes 226, 236 are approximately twenty-one to twenty-three yards (19.2 to 21 meters) long in some embodiments of the modified soccer field 201.

In some embodiments of the present modified soccer game, one or more rules depend on whether one or more actions identified in a set of modified soccer rules occur inside of a goal box 226, 236 on a modified soccer field 201. A "Goal Box Soccer Rule" is a rule in the present modified soccer game for which the application of the rule depends on whether one or more identified actions occur during active play inside of one or more goal boxes 226, 236 on a modified soccer field 201.

One exemplary Goal Box Soccer Rule provides that a team is penalized if a player on the team, other than a goal keeper on a defending team, is in a goal box 226, 236 of the defending team for more than a set period of time without possession of the soccer ball. In some embodiments of the present modified soccer game, the set period of time is approximately five seconds. This rule prevents players on either team 304, 305 from waiting near the opposing team's goal 227, 237 for a pass and it prevents defending goal keepers from being overwhelmed by numerous close kick shots on goal.

One exemplary Goal Box Soccer Rule provides that a shot on goal which is made by an attacking team from within a defending team's goal box 226, 236, and which goes in the defending team's goal 227, 237, is only counted as a scored goal if the shot on goal is made by either a header shot or a scissor kick shot. For example, in certain embodiments of the present modified soccer game, if a player on a first team makes a kick shot on goal (via any kick other than a scissor kick) from within a second team's goal box 226, 236 and the soccer ball goes into the second team's goal 227, 237, then the kick shot on goal is not counted as a scored goal for the first team and possession of the soccer ball is given to the second team. This rule helps keep defending goal keepers from being overwhelmed by numerous up close kick shots on goal, it requires kick shots on goal to be made from outside the goal box, thereby generating more distance kick shots on goal, which are more impressive to watch, and it creates many exciting opportunities for header shots and scissor kick shots.

Conventional soccer games are filled with fouls such as tripping, holding, and shirt pulling that routinely break up scoring drives and momentum. A typical penalty for many of these fouls is a "direct free kick", also called a "direct kick", which means that the opponent may kick directly at the goal from the location where the penalty occurred. The rules of conventional soccer define certain fouls that result in a direct kick. Fouls which result in a direct kick may be referred to as "direct kick fouls". Because these penalties often occur at a large distance from the goal, direct kicks are usually not a meaningful deterrent to the commission of direct kick fouls. These fouls often prevent players from showcasing their skills because opponents routinely commit fouls rather than let players beat them with impressive moves. It is generally much more exciting to watch players dribble the ball further one-on-one, making impressive moves to beat an opponent along the way, than to watch fouls which foil these moves and resulting conventional direct kicks. To reduce the number of direct kick fouls that break up scoring drives, great moves, and attacking momentum, an exemplary version of the present modified soccer game awards a direct kick to be taken from a Direct Kick Spot 224, 234 located at a set distance in front of a goal 227, 237 for direct kick fouls. By having direct kicks taken from the Direct Kick Spots 224, 234, rather than the spot of the foul, the present modified soccer game will increase the likelihood of scoring on many direct kicks as compared to direct kicks in conventional soccer. Accordingly, this rule will discourage direct kick fouls and allow fuller display of ball handling skills and more impressive moves and scoring drives.

The Direct Kick Spots 224, 234 are each located approximately halfway between two opposing sidelines 212, 213 on the modified soccer field 201. A first Direct Kick Spot 224 is located on a first side of a midline 211 and a second Direct Kick Spot 234 is located on a second side of the midline 211. The Direct Kick Spots 224, 234 are located further from the respective goals 227, 237 on the modified soccer field 201 than penalty marks 125, 135 are from the respective goals 127, 137 on a conventional soccer field 101. Thus, direct kicks taken from the Direct Kick Spots 224, 234 on the modified soccer field 101 are more exciting than conventional penalty kicks because the increased distance of the Direct Kick Spots 224, 234 from the goals 227, 237 makes the outcome much less certain compared to the almost certain likelihood of scoring in conventional penalty kicks. This creates more drama and excitement. In certain embodiments of the present modified soccer field layout, the first Direct Kick Spot 224 is located approximately fifteen to twenty yards (13.7 to 18.3 meters) in front of a first goal 228 and the second Direct Kick Spot 234 is located the same distance of approximately fifteen to twenty yards (13.7 to 18.3 meters) in front of a second goal 238.

In conventional soccer, penalty kicks occur to break a tie game or when a foul is committed in a penalty box 223, 233. In conventional soccer, penalty kicks often contain little drama and are usually not very exciting in that penalty kicks are expected to score goals almost all of the time because they are typically taken from a penalty mark 225, 235 which is a relatively short distance, approximately twelve yards (11 meters), in front of the goal. A penalty kick opportunity that is not a guaranteed score is more exciting. In certain embodiments of the present modified soccer game, in order to make penalty kicks to break tie games more exciting, penalty kicks to break tie games are taken from a Direct Kick Spot 224, 234. However, to discourage fouls in the penalty boxes 223, 233, penalty kicks resulting from fouls committed inside a penalty box 223, 233 are still taken from a penalty mark 225, 235 in certain embodiments of the present modified soccer game.

A "yellow card foul" in the modified soccer game is any foul or action that would result in the issuance of a yellow card to a player in conventional soccer. To further reduce the number of fouls that break up scoring drives and attacking momentum, an exemplary version of the present modified soccer game requires a team to play with one less player for a set penalty period of time for each yellow card foul committed beyond a set penalty number of yellow card fouls allowed per team per game. The penalty for yellow card fouls in some versions of the present modified soccer game is in addition to any penalty that results from the commission of a yellow card foul based on conventional soccer rules. If the team commits an additional yellow card foul, then the team must play without an additional player for a set penalty period of time for each additional yellow card foul committed by one of the team's players. In some embodiments, the player or players who are removed from the game for the set penalty period of time for yellow card fouls must stay in a holding zone adjacent to the field of play, near the midline, and are permitted to reenter the field at the midline immediately after the expiration of the set penalty period of time. In certain embodiments of the present modified soccer game, the set number of yellow card fouls per team per game is one to three. In some embodiments of the present modified soccer game, the set number of yellow card fouls per team per game is zero. In certain embodiments, the set penalty period of time that a team must play with fewer players is approximately two to five minutes. In some embodiments, there is a maximum number of players who may be removed from the soccer field per team at a time. In some embodiments, the maximum number of players that may be removed from the playing field at a time for yellow card fouls is one to two players per team.

In certain embodiments of the present modified soccer game, referees are permitted to use video replay to determine whether a foul was committed. Additionally, unlike conventional soccer, some embodiments of the present modified soccer game utilize multiple officials on the field at a time during a game.

Conventional soccer games are not sufficiently suitable for television advertising because there are no timeouts and the two continuous forty-five minute periods of play do not allow sufficient time slots for television advertising as presented in the U.S. television market. An exemplary version of the present modified soccer game thus instead is played in three periods with breaks in between the periods. Some embodiments of the present modified soccer game are played in three thirty minute periods with two to five minute breaks between the periods. Additionally, a version of the present modified soccer game allows teams to call a set number of timeouts per period. Timeouts may generally be called by a team when the team's goal keeper has possession of the ball or before a throw-in, direct kick, or corner kick to be taken by that team. In some embodiments of the present modified soccer game, each team is allowed a one minute timeout per period and two fifteen second timeouts per period. By adjusting the periods of play and by allowing timeouts, the present modified soccer game makes soccer more attractive to U.S. television commercial sponsors and opens the sport to widespread television advertising.

Substitutions are allowed in conventional soccer games, but players who leave the field for substitutions are not permitted to later reenter the field to play during the same game in conventional soccer. In order to shift the focus of soccer towards speed and attacking moves throughout the game, certain embodiments of the present modified soccer game allow player substitutions throughout the game, such that substituted players may reenter the game. In certain embodiments of the present modified soccer game, teams are permitted to substitute players at any point of the game that active play is stopped. For example, in certain embodiments of the present modified soccer game, teams are permitted to substitute players during timeouts and before throw-ins, direct kicks and corner kicks. In certain embodiments of the present modified soccer game, teams are allowed to freely substitute players up to a given maximum number of active players for each game, wherein all active players may leave and reenter the game. The number of "active players" is the maximum total number of players who are allowed to play for each team during each game. The number of "active players" per team per game is typically greater than the number of players allowed on the field per team at a time during a game. In one exemplary version of the present modified soccer game, each team has ten players per team on the field at a time, with a total of fifteen different active players per team permitted through the course of the game.

As discussed above in more detail, an exemplary modified soccer game may include the following basic exemplary differences—alone, in part, or in combination—from conventional soccer:

1. The present modified soccer field includes Forward Lines and Forward Areas. The present modified soccer game is played according to at least one Forward Area Soccer Rule.
2. A limited, set number of players from each team are allowed in each Forward Area at a time.
3. A team has a set period of time, also known as a goal clock, to take a shot on goal once the team has possession of a soccer ball in an opposing team's Forward Area.
4. If a player, other than a goal keeper, on a first team kicks a soccer ball from the first team's Forward Area to a second team's Forward Area without the soccer ball being touched by another player before landing in the second team's Forward Area, then the second team is given a throw-in at a sideline in front of the first team's Forward Area.
5. A player on a first team who makes a corner kick or throw-in in a second team's Forward Area must reenter a modified soccer field outside of the second team's Forward Area after making the throw-in or corner kick.
6. A team is allowed a set number of defensive out of bounds per period off the team in the team's Forward Area. If the team has reached the set number of defensive out of bounds allowed per period, then the next out of bounds off the team in the team's Forward Area results in a direct kick for an opposing team.
7. An offsides penalty is only assessed in the present modified soccer game if a soccer ball is passed from an attacking player—who is outside of an opposing team's Forward Area at the time of the pass—to an attacking teammate—who is inside the opposing team's Forward Area at the time of receipt of the pass—and there are not at least two defending players on the opposing team between the attacking teammate and the defending team's endline at the time of receipt of the pass.
8. When a corner kick is made by a player on a first team in a second team's Forward Area, only one other player from the first team is allowed in the second team's Forward Area at the time of the corner kick, and a goal keeper on the second team is the only player from the second team allowed in the second team's Forward Area at the time of the corner kick.
9. The present modified soccer game is played in three separate periods, with a break between periods.
10. The present modified soccer game is played with fewer players per team on a modified soccer field than conventional soccer.
11. The present modified soccer game requires each team to have a minimum number of players, not including a defending goal keeper, on each side of a midline on a modified soccer field at a time after a first change of possession during each period.
12. The size of goal boxes, also known as goal areas, on a modified soccer field is expanded relative to the size of goal boxes on a conventional soccer field. The present modified soccer game is played according to at least one Goal Box Soccer Rule.
13. A team is penalized if a player on the team, other than a defending goal keeper, is in a defending team's goal box for more than a set period of time without possession of a soccer ball.
14. A shot on goal which is made by an attacking team from within a defending team's goal box, and which goes into the defending team's goal, is only counted as a scored goal if the shot on goal is made via either a header shot or a scissor kick shot.
15. Player substitutions are allowed such that substitute players may reenter the game in the present modified soccer game.
16. Teams are allowed to call timeouts in the present modified soccer game.
17. If an offending team has exceeded a set penalty number of yellow card fouls per team per period, then the offending team must play with one less player for a set penalty period of time for each yellow card foul committed beyond the set penalty number of yellow card fouls. The offending team must play without an additional player for a set penalty period of time for each additional yellow card foul committed by one of the offending team's players.
18. Direct kicks resulting from direct kick fouls are taken from a Direct Kick Spot located on the modified soccer field.
19. Penalty kicks for breaking a tie game are taken from a Direct Kick Spot on a modified soccer field.

These modifications transform soccer from an often plodding ritual into an attacking game with emphasis on setting up plays leading to clean shots on goal. Professional soccer players are better able to use and display their incredible ball handling skills. Numerous easily recognizable set plays are allowed to develop, there are many more shots on goal, there are more goals per game, and shots on goal are often taken from a significant distance from the goal where the power and accuracy of soccer strikers can be greatly appreciated.

I claim:

1. A method of playing a game of soccer between two opposing teams each having a plurality of players, the method comprising:

providing a field having a field surface;

delineating lines on the field surface corresponding to opposing sidelines, opposing endlines oriented perpendicularly to the sidelines, goals situated at the center of each of the endlines, penalty boxes encompassing an area along each of the endlines, goal boxes encompassing an area in front of each of the goals and enclosed within the penalty boxes, two Forward Lines, and two Forward Areas, wherein the Forward Lines extend across a width direction of the field surface, wherein a first Forward Line is located on a first side of a midline, wherein a second Forward Line is located on a second side of the midline, wherein the first Forward Line is located between the midline and a first endline, wherein the second Forward Line is located between the midline and a second endline, wherein a first Forward Area is located on the first side of the midline, wherein a second Forward Area is located on the second side of the midline, wherein the Forward Areas are defined by length direction sides and width direction sides, wherein the length direction sides of the Forward Areas are defined by two opposing sidelines on the field surface, wherein the width direction sides of the first Forward Area are defined by the first endline and the first Forward Line, and wherein the width direction sides of the second Forward Area are defined by the second endline and the second Forward Line;

actively playing the game of soccer on the field surface; and employing, while game play is not stopped, at least one Forward Area Soccer Rule in response to game play inside of one or more of the Forward Areas on the field surface, wherein the step of actively playing the game of soccer is modified by the employed Forward Area Soccer Rule by restricting a number of players allowed in at least one of the Forward Areas.

2. The method according to claim 1 wherein the first Forward Line is located approximately twenty to twenty-six yards in front of the first endline, and wherein the second Forward Line is located approximately twenty to twenty-six yards in front of the second endline.

3. The method according to claim 1 further comprising providing two goal boxes on the field surface, wherein a first goal box is located on the first side of the midline, wherein a second goal box is located on the second side of the midline, wherein the goal boxes are defined by length direction sides and width direction sides, wherein the length direction sides of the goal boxes are approximately seven to nine yards in length, wherein the width direction sides of the goal boxes are approximately twenty-one to twenty-three yards in length, wherein a first width direction side of the first goal box is located on along the first endline, wherein a second width direction side of the first goal box is located approximately seven to nine yards in front of the first endline, wherein a first width direction side of the second goal box is located on the second endline, wherein a second width direction side of the second goal box is located approximately seven to nine yards in front of the second endline, and wherein the length direction sides of each goal box are spaced approximately equidistant from the center of the field.

4. The method according to claim 3 further comprising penalizing a first team if a player, other than a defending goal keeper, of the first team is in either goal box for more than a set period of time without possession of a ball.

5. The method according to claim 3 further comprising playing the game according to a rule which provides that a shot on goal which is made by a first team from within a second team's goal box and which causes a ball to go into the second team's goal is only counted as a scored goal for the first team if the shot on goal is made by either a header shot or a scissor kick shot.

6. The method according to claim 1, wherein the Forward Area Soccer Rule further comprises penalizing a first team if more than a set number of players from the first team are in either Forward Area at a time.

7. The method according to claim 1 further comprising playing the game with seven to ten players on the field per team at a time.

8. The method according to claim 1, wherein the Forward Area Soccer Rule further comprises awarding a throw-in to a first team at a sideline in front of a Forward Area of a second team if a player on the second team kicks a ball from a Forward Area of the second team to the Forward Area of the second team without the ball contacting another player prior to entering the Forward Area of the first team.

9. The method according to claim 1, wherein the Forward Area. Soccer Rule further comprises assessing an offsides penalty to a first team if a pass is made from a passing player on the first team who is located outside of a Forward Area of a second team to a receiving player on the first team who is located inside the Forward Area of the second team, if there are not at least two players of the second team between said receiving player on the first team and an endline of the second team at the time of receipt of the pass.

10. The method according to claim 1, wherein the Forward Area Soccer Rule further comprises awarding a first team a direct kick for each defensive out of bounds off of a player on a second team in a Forward Area of the second team beyond a set number of defensive out of bounds per team per period.

11. The method according to claim 1, wherein the Forward Area Soccer Rule further comprises awarding a corner kick to a first player on a first team inside a Forward Area of a second team;

allowing only one player, a second player, on the first team to be located inside the Forward Area of the second team at the time of said corner kick; and allowing only one player, a goal keeper, on the second team to be located inside the Forward Area of the second team at the time of said corner kick.

12. The method according to claim 1, wherein the Forward Area Soccer Rule further comprises assessing a penalty to a second team if the second team maintains possession of a ball in a Forward Area of a first team for a time period exceeding a set time period without taking a shot on goal.

13. The method according to claim 12, wherein the Forward Area Soccer Rule further comprises resetting the set time period for the second team to take a shot on goal if the first team obtains possession of the ball outside of the Forward Area of the first team, wherein a new set time period for the second team to take a shot on goal will begin if the second team subsequently has possession of the ball inside of the Forward Area of the first team.

14. The method according to claim 12, wherein the Forward Area Soccer Rule further comprises resetting the set time period for the second team to take a shot on goal if the ball goes out of bounds off of a player on the first team in the Forward Area of the first team, wherein a new set time period for the second team to take a shot on goal will begin if the second team subsequently obtains possession of the ball in the Forward Area of the first team.

15. The method according to claim 12, wherein the Forward Area Soccer Rule further comprises penalizing a team if a player on the team leaves the Forward Area of the first team during the set time period for the second team to take a shot on goal and reenters the Forward Area of the first team before the set time period for the second team to take a shot on goal has either expired or been reset.

16. The method according to claim 1 further comprising requiring a second team to play with one less player for a set penalty time period if the second team has exceeded a set penalty number of yellow card fouls per period per team; and requiring the second team to play without an additional player for the set penalty time period for each additional yellow card foul committed by a player on the second team exceeding the set penalty number of yellow card fouls per period per team.

17. The method according to claim 1 further comprising providing two Direct Kick Spots on the field surface, wherein a first Direct Kick Spot is located on the first side of the midline, wherein a second Direct Kick Spot is located on the second side of the midline, wherein the first Direct Kick Spot is located approximately fifteen to twenty yards in front of a first goal, wherein the second Direct Kick Spot is located approximately fifteen to twenty yards in front of a second goal, wherein the Direct Kick Spots are located halfway between two opposing sidelines on the field surface; and awarding a direct kick to a first team for a direct kick foul committed by a second team, wherein the first team takes the direct kick from a Direct Kick Spot located approximately fifteen to twenty yards in front of a goal of the second team.

18. The method according to claim 1 further comprising playing the game in three time periods having breaks between the three time periods.

19. The method according to claim 1 further comprising requiring each team to have a minimum number of players, not including a defending goal keeper, on each side of the midline on the field after a first change of possession during each period.

20. The method according to claim 1 further comprising allowing player substitutions during the game up to a set number of active players per team per game, wherein active players who leave the game during the player substitutions are permitted to reenter the game during subsequent player substitutions.

21. The method according to claim 1 further comprising allowing each team to call a set number of timeouts per period.

22. The method according to claim 1, wherein the total number of non-goal keeper players from each team that are allowed in a Forward Area at the same time is in the range of three to five players.

23. The method according to claim 12, wherein the penalty comprises loss of possession of the ball.

24. A method of playing a game of soccer between two opposing teams each having a plurality of players, the method comprising:

providing a field having a field surface;

delineating lines on the field surface corresponding to opposing sidelines, opposing endlines oriented perpendicularly to the sidelines, goals situated at the center of each of the endlines, penalty boxes encompassing an area along each of the endlines, goal boxes encompassing an area in front of each of the goals and enclosed within the penalty boxes, two Forward Lines, and two Forward Areas, wherein the Forward Lines extend across a width direction of the field surface, wherein a first Forward Line is located on a, first side of a midline, wherein a second Forward Line is located on a second side of the midline, wherein the first Forward Line is located between the midline and a first endline, wherein the second Forward Line is located between the midline and a second endline, wherein a first Forward Area is located on the first side of the midline, wherein a second Forward Area is located on the second side of the midline, wherein the Forward Areas are defined by length direction sides and width direction sides, wherein the length direction sides of the Forward Areas are defined by two opposing sidelines on the field surface, wherein the width direction sides of the first Forward Area are defined by the first endline and the first Forward Line, and wherein the width direction sides of the second Forward Area are defined by the second endline and the second Forward Line;

actively playing the game of soccer on the field surface; and employing, while game play is not stopped, at least one Forward Area Soccer Rule in response to game play inside of one or more of the Forward Areas on the field surface, wherein the step of actively playing the game of soccer is modified by the employed Forward Area Soccer Rule by restricting a number of players allowed in each of the Forward Areas.

* * * * *